US007638696B2

(12) United States Patent
Clark

(10) Patent No.: US 7,638,696 B2
(45) Date of Patent: Dec. 29, 2009

(54) REDUCED FRICTION PIANO ACTION PINS

(75) Inventor: Bruce Clark, Nottingham, NH (US)

(73) Assignee: Burgett, Inc., Sacramento, CA (US)

( * ) Notice: Subject to any disclaimer, the term of this patent is extended or adjusted under 35 U.S.C. 154(b) by 0 days.

(21) Appl. No.: 11/765,438

(22) Filed: Jun. 19, 2007

(65) Prior Publication Data

US 2008/0006137 A1 Jan. 10, 2008

Related U.S. Application Data

(60) Provisional application No. 60/815,063, filed on Jun. 19, 2006.

(51) Int. Cl.
*G10C 3/18* (2006.01)

(52) U.S. Cl. ..... 84/251; 84/239

(58) Field of Classification Search ..... 84/251, 84/239

See application file for complete search history.

(56) References Cited

U.S. PATENT DOCUMENTS 4,386,455 A 6/1983 Drasche
4,685,371 A * 8/1987 Levinson ..... 84/239
4,920,847 A 5/1990 Conklin, Jr.
5,035,168 A 7/1991 Williams et al.
5,471,902 A 12/1995 Chaplin
2002/0189422 A1 * 12/2002 Yoshisue et al. ..... 84/423 R
2006/0174753 A1 * 8/2006 Aisenbrey ..... 84/600

FOREIGN PATENT DOCUMENTS

EP 16222126 A1 2/2006
GB 1488782 A 10/1977

OTHER PUBLICATIONS

Aluminum Anodizers Council. Hardcoat Anodizing, at <http://web.archive.org/web/20000516171324/htp://anodizing.org/hcwebdoc.htm>, May 16, 2000, retrieved Dec. 10, 2007.

* cited by examiner

*Primary Examiner*—Jianchun Qin
(74) *Attorney, Agent, or Firm*—Craig A. Simmermon

(57) ABSTRACT

An improved key pin and action pin that is resistant to corrosion, is very durable and has surfaces with a very low coefficient of friction. The pins are preferably made of aluminum or aluminum alloy with a hardened anodized oxide surface. The anodized pins may be polished to provide a surface with a very low coefficient of friction that is also very durable. As a consequence of the low friction and corrosion resistance, piano actions using the pins have less resistance providing an action with a lighter "feel" and consistency. Longevity of the components of the action and the pins is also greatly improved especially for pianos located in humid climates where traditional pins experience corrosion.

6 Claims, 2 Drawing Sheets

REDUCED FRICTION PIANO ACTION PINS

CROSS-REFERENCE TO RELATED APPLICATIONS

This application claims priority from U.S. provisional application Ser. No. 60/815,063 filed on Jun. 19, 2006, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention pertains generally to action mechanisms of a piano, and more particularly to an improved keyboard action with low friction, corrosion resistant anodized aluminum key pins and action guide pins.

2. Description of Related Art

The finest pianos provide a uniform "feel" when the keys are depressed by the musician as the instrument is played. Force, applied to a key by the pianist, is transmitted through a repetition assembly and a hammer shank accelerating a hammer made from wood and felt. Traveling very rapidly, the hammer strikes a set of strings causing them to vibrate. As the strings vibrate, they shake the soundboard which in turn causes the ambient air to vibrate. It is this vibration in the air that is perceived as sound, or music, from the piano. The volume and tonal quality of the sound that is produced by the strings depends on force applied to the key by the musician and the interaction of the large number of moving parts that constitute the "action" of the piano.

A uniform feel for each key, with the right amount of resistance, permits the musician to have control over the volume of the music and to play expressively. It is important that the applied force that is required to depress each key to be similar to provide an even overall feel. In a piano, volume and tone change as function of the speed of the hammer as it hits the string. A pianist is able to control this by varying the force applied to each key. If the force required is significantly different from key to key, then it becomes difficult to control the sounds made by the piano. The ability to vary the volume and tone of a musical note by controlling the speed of the hammer striking the strings is central to the skill of a pianist. It is in this fashion that a skilled performer can play a wide variety of compositions. Some pieces require quick, sharp combinations of notes; others utilize softer more gentle legato combinations. The pianist depends on the action to be in control of his own artistic vision.

The overall "touch" or "feel" of the keyboard of an acoustic piano is the result of the weight of the parts of the action and the resistance from friction between the moving parts of the components of the action. Precision machining and good quality control allow piano manufacturers to make piano actions that have uniform weights and tight tolerances. However, friction that occurs between the components of the action of the piano can be unpredictable and difficult to control.

Action centers are the pivotal connections between components of the action around which the various parts rotate. As with any shaft and bearing system, there must be limited side to side movement, while the parts rotate smoothly with minimal friction. Components of these action centers are typically held together with a lateral or transverse pin with suitable bushings. In the case of piano actions this bushing material is a dense woven cloth called bushing cloth.

With a piano key, the key pins and bushings are not a shaft and bearing system. Rather, the key pins and associated bushings guide the motion of the key as it rotates on a balance hole in the bottom of the body of the key. The resistance caused by the key bushings rubbing on guide pins is undesirable because this resistance slows the movement of the keys and adds directly to the effort that the pianist must expend to play the piano.

Action center pins are conventionally made of brass with a nickel coating. The purpose of the nickel coating is to decrease the friction between the cloth bushing and the pin. Because the pin is not particularly open to the air, corrosion is less of a problem than heat created in the bushing as the piano is played. Heat can be a significant problem because it can cause the cloth bushing to swell and cause the action center to seize up or greatly increase in friction. Anything that can reduce the friction in the action pins is significant and valuable in the manufacture of pianos.

Key pins, the guide pins of the key, are typically made of brass or soft steel with thin coating of nickel. Like the action center pins, the purpose of the nickel coating on the key pins is to decrease the friction between the cloth bushing and the pin. Because the key pin is exposed to the atmosphere, corrosion can be a significant problem particularly in a high humidity environment. Corrosion can greatly increase the friction between the key and the keypin. Correcting this condition requires disassembly of the keyboard to provide access to the corroded parts. Polishing key pins is laborious, time consuming and the results are temporary. Attempts to apply coatings of other metals such as chrome to the key pins have been unsuccessful. Such coatings have either not resisted corrosion or have frictional coefficients that are too high resulting in a sluggish or heavy action.

Durability of the conventional key pins and bushings exposed to repetitive motion has been limited due to the soft nature of the surface coating as well as corrosion. As corrosion adds friction, excessive wear on the cloth bushings that guide the key can occur. Worn key bushings cause the key to move from side to side in a loose and uncontrolled fashion. Added friction can also lead to sticking keys. While the key pins are capable of replacement, key pins are not normally replaced because it is an expensive, time consuming and laborious task.

There have been many attempts to improve the design of piano actions and bearings to reduce friction in the action centers and to increase the longevity of the parts. Bushings of various materials other than traditional wool felt have been proposed, some with lubricants such as graphite, silicone or soap. However, such materials do not eliminate the problem of corrosion or increase the durability of the action pins that typically lose lubricity over time.

Alternative action designs with additional moving parts and action points have also been developed. Such designs are still vulnerable to corrosion in humid environments and to limited durability during long use.

Accordingly, there is a need for a piano action using low friction action pins and key pins that exhibit low friction and extended durability over the lifetime of the piano. The present invention satisfies these needs, as well as others, and is generally an improvement over the art.

BRIEF SUMMARY OF THE INVENTION

Piano balance rail key pins, front rail key pins and action pivot pins have been manufactured from the same materials for more than 100 years. Action pins made from brass plated with nickel and key pins made from brass or soft steel plated with nickel are still used by manufacturers today. The present invention is an improved key pin or action pin that is resistant to corrosion, very durable and has surfaces with a very low coefficient of friction. As a consequence of the low friction and corrosion resistance, piano actions using the pins have less resistance providing an action with a lighter "feel" and consistency. Longevity of the components of the action and the pins is also greatly improved especially for those in humid climates that experience corrosion with traditional pins. For example, wear seen in cloth key bushings and metal key pins is greatly reduced requiring fewer repairs during the useful life of the piano.

The pins of the invention can be used in any piano action design. The invention is particularly useful for grand pianos and piano restorations. In one embodiment, the pins are made of aluminum or aluminum alloy. A hardened surface is provided to the pins through anodization of the pins. A hardened surface of aluminum oxide, for example, can have hardness that preferably ranges from approximately Rockwell C60 to approximately Rockwell C70. The hardened anodized surface can optionally be polished to provide an even smoother surface.

Anodized aluminum pins also reduce the friction between the key pins and the key bushings and other action components resulting in an immediate increase in the performance of the piano when used as replacement pins.

According to one aspect of the invention, a piano action pin is provided that has an elongate body with a longitudinal axis with a hardened oxide formed on the surface of the body of the pin.

Another aspect of the invention is to provide a piano action pin that has a hardened oxide layer with a hardness of between approximately Rockwell C60 and approximately Rockwell C70.

A further aspect of the invention is to provide a low friction piano action that is has a light "feel" and every key is equally responsive to the force and speed of the fingers of the pianist.

Still another aspect of the invention it to provide a piano action with pins that are resistant to wear with extended use and resistant to corrosion in humid climates.

Another aspect of the invention is to provide replacement balance rail key pins, front rail key pins and action center pins that will immediately reduce the friction between the parts of the piano action and improve the playability of the piano.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Figure 1:
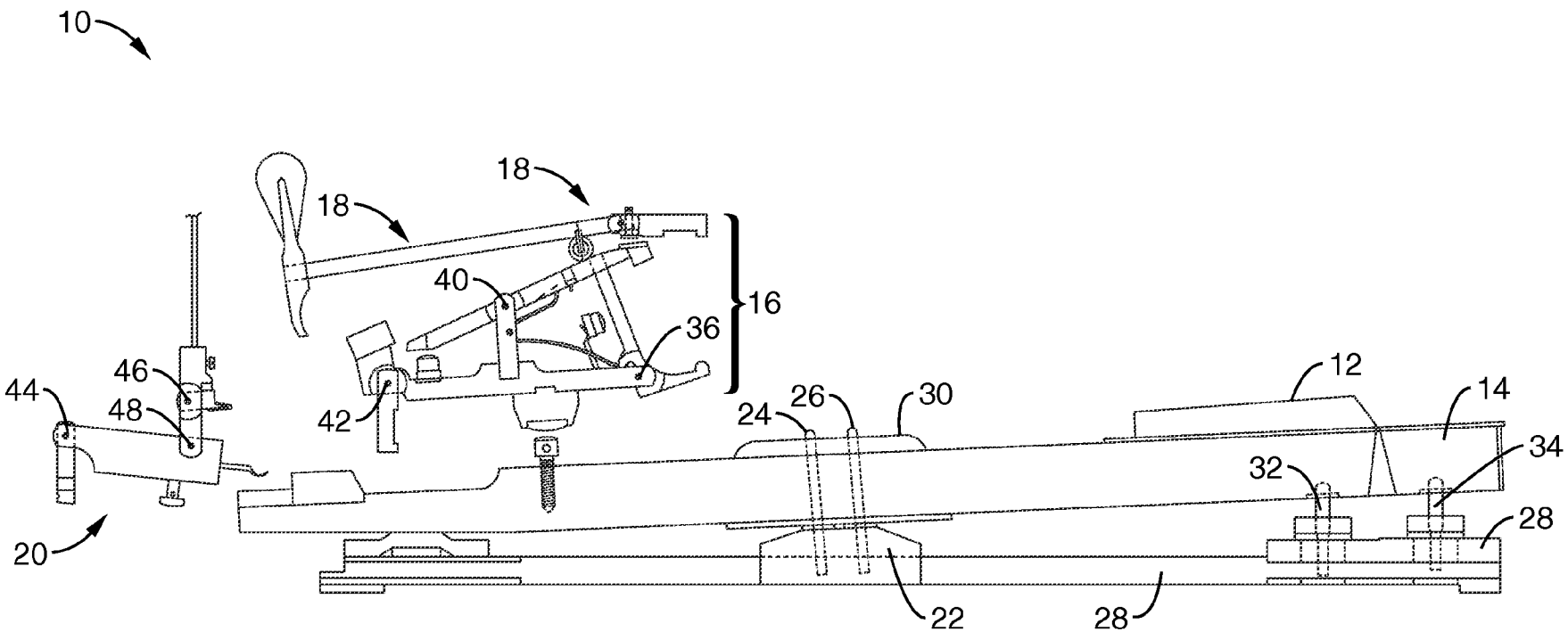
FIG. 1 is an exploded side view of an illustrative piano action with pins according to the present invention.
Figure 3:
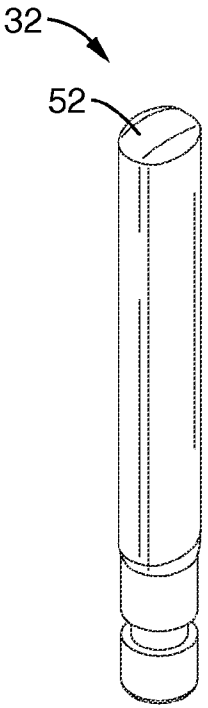
FIG. 3 is a perspective side view of a front rail pin according to the present invention.
Figure 2:
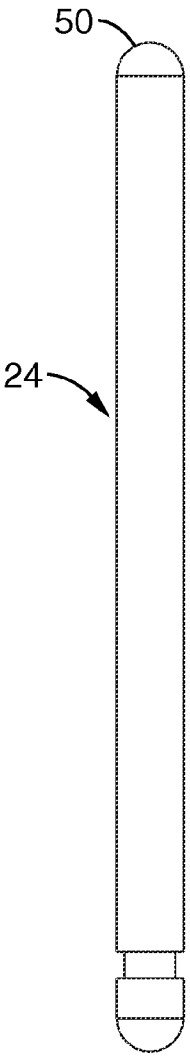
FIG. 2 is a side view of a balance rail pin according to the present invention.

Referring more specifically to the drawings, for illustrative purposes the present invention is embodied in the apparatus generally shown in FIG. 1 through FIG. 3. It will be appreciated that the apparatus may vary as to configuration and as to details of the parts without departing from the basic concepts as disclosed herein.

Several different piano action designs have been developed in the art over the years, each a variation on a theme. The purpose of the piano action is to accurately translate the finger movements of the pianist into a musical tone from the strings and soundboard. Changes in timing, speed and force of the keystroke should result in a corresponding change in the volume, intensity and duration of the tones produced by the instrument.

The typical grand piano action has a keyboard with eighty-eight keys. A mechanism is connected to each key to cause a hammer to strike a predetermined set of strings. In the conventional action mechanism, the force applied to a key is generally transmitted from the key to a wippen assembly, from the wippen assembly through the balancier and jack to the hammer shank, and finally the hammer strikes the strings.

One common element in piano actions is the action center pin that may be found in several places on the wippen and the hammer shank, the two typical pivoted levers in a piano action. A second set of pins found in the typical action are the balance rail key pins and the front rail key pins associated with the sharp and natural keys.

Turning now to FIG. 1, an exploded side view of a conventional piano action 10 is shown to illustrate the types of action centers and guide pins that are suitable for the present invention. A sharp key 12 and a natural key 14 and their associated balance rail pins and front rail pins are shown. A wippen assembly 16, a hammer shank assembly 18 and a damper assembly 20 are shown to illustrate the typical action centers and rail pins for each key.

The sharp key 12 or the natural key 14 have an elongated body that pivots up and down on a balance rail 22 as the keys are depressed and released during play. Sharp key 12 is pivotally secured to the balance rail 22 with a balance rail pin 24 and the natural key 14 is secured to the balance rail 22 with a balance rail pin 26 in FIG. 1.

A balance rail pin 24, 26 is normally cylindrical with an optional rounded end 50 as seen in FIG. 2. Cylindrical body of pin 24, 26 includes a single notch. Said notch being a longitudinal segment of said cylindrical body with a smaller outside diameter than that of the rest of said cylindrical body, said longitudinal segment having an essentially cylindrical shape, a common longitudinal axis with said cylindrical body, and a length of 0.1-10 percent of the total length of said cylindrical body. The pin 24 has a sufficient length so as to be pressed securely into the balance rail 22 that is mounted to the key frame 28. The balance rail pin 24 or 26 preferably extends up to about 3 mm past the top of the body of the key. There are various diameters and lengths of balance rail pins in the marketplace to provide different key heights.

European, American and Asian piano manufacturers use standard diameter balance rail pins of different diameters. For example, standard American pins are 3.71 mm in diameter with lengths of 54 mm and 67 mm. Standard European pins are 3.5 mm in diameter with lengths of 54 mm and 67 mm. Old Steinway pins are 4.12 mm in diameter with lengths of 57 mm and 67 mm.

Functionally, at the bottom of the key the balance rail pin 24, 26 defines the key's pivot point. The location of the key is set at the bottom of the key and therefore the key should not move in any direction on the balance rail pin 24, 26. The key should, however, be free to rotate easily through its full range of motion.

The balance rail pin 24, 26 extends through the top of the key and out the key button 30 and serves as a guide to hold the key upright. The key button 30 is located at the top of the key and has a slot (not shown) that is perpendicular to the front of the keyboard frame 28. In this slot are placed cloth bushings that ride on the balance rail pin. The balance rail pins 24, 26 hold the top of the key 12, 14 square. Each key typically has cloth bushings that ride on the balance rail pin. Friction may be controlled by loosening the fit of the bushings by making the slot they define in relation to the pin somewhat larger. A low friction key pin is desirable since friction in the key pins is perceived directly as touch resistance.

In the illustration shown in FIG. 1, the sharp key 12 and the natural key 14 have front rail pin 32 and front rail pin 34 respectively that guide the keys in the vertical motion. The front rail pins 32, 34 are pressed firmly into the front rail in a round hole. The front rail pins maintain the position of the keys limiting movement from side to side. The key is guided on the front rail key pins by key bushings glued into a mortise or slot in the bottom of each key.

Referring also to FIG. 3, a perspective view of one embodiment of a front rail 32, 34 is shown. The preferred shape of the front rail pin 32, 34 is cylindrical on the end that is mounted to the frame and generally ovoid or ellipsoid on the other end that resides in the slot of the key as seen in FIG. 1. Body of pin 32, 33 includes a single notch. Said notch being a longitudinal segment of said body with a smaller outside diameter than that of the rest of said body, said longitudinal segment having an essentially cylindrical shape. a common longitudinal axis with said body, and a length of 0.1-10 percent of the total length of said body.

The ellipsoid or non-circular cross-sectional shape 52 of the pin limits the upward motion of the key as well as the sideways movement of the keys of the keyboard. The front rail pin for each key is oriented and mounted in the keyboard frame 28.

Normally, cloth bushings ride directly on the pin 32, 34 to guide the key. These bushings prevent noise from the key striking the interior of the slot of the wooden key 12,14 and can have an effect on the way the piano plays. If the bushings are worn or damaged the keys may be noisy and have undesired movement. If the bushings are too tight or there is too much friction between the pin and the bushing from corrosion, then the action will be sluggish because the key will be difficult to depress.

At the present time, there are standardized diameters and lengths of front rail pins 32, 34 used by European, American and Asian manufacturers. For example, American standard short key front rail pins have a bottom diameter of 4.2 mm, a guiding width of 3.71 mm and a length of 37 mm. The standard long key front pins have a length of 40 mm. Although front key pins, balance rail pins and pivot pins may be of standardized dimensions, it will be understood that pins of any size and dimensions can be used with the invention.

Referring back to FIG. 1, the piano action also has a number of pivot action points that use center pins. The wippen assembly 16 has a jack centered pin 36, a shank centered pin 38, a balancier centered pin and a repetition center pin 40. The wippen or repetition assembly 16 is the most complicated component of the piano action and friction at these centers will have a significant influence on the feel of the piano.

The hammer shank center in particular can have a major influence on the feel of the action. Increased friction from corrosion of the pin 38 at the hammer shank pivot will make the key difficult to press and cause the action to feel sluggish. Likewise, the damper lever flange center pin 44, the sostenuto spring tab center pin 46 and the sostenuto top flange center pin 48 in the damper assembly 20 may experience corrosion or wear from use.

Exposed to the atmosphere and humidity, piano key pins can oxidize and otherwise corrode, greatly increasing the friction in the keys through the balance and front rail pins. Steel pins will rust and brass pins will corrode over time and become rough increasing the friction in the action. Nickel plating will also corrode in humid environments even though the plating will provide the pin some initial protection from corrosion.

According to the invention, key pins are provided that are durable, have a low coefficient of friction and are very resistant to oxidization, even in very humid climates. The pins are preferably made from aluminum or an aluminum alloy with a hard anodization oxide layer or coating.

Anodization is a process of hardening the natural oxide layer that is present on the surfaces of certain metals. Unlike steel or iron, a thin oxide layer forms on aluminum that insulates the metal from further corrosion. This natural oxide layer can be thickened and hardened by anodization providing a hard corrosion resistant and wear resistant surface. Similar results can be achieved with the anodization of other metals such as zinc, magnesium and titanium.

The result of the anodization process is a hard surface in the pin with a hardness typically ranging from approximately Rockwell C60 to approximately Rockwell C70. Unlike nickel or other metal coatings in the art, anodized surfaces will not crack, flake or otherwise fail through normal wear. Surface wear from friction between the pins and the joint members is also greatly reduced resulting in a piano action that is able to endure hundreds of thousands of impacts or events without losing its strength, corroding or wearing out. Not only is the anodized surface corrosion resistant and wear resistant, the surface has been observed to have low friction characteristics.

During conventional anodization, the aluminum component being treated serves as the anode while direct current is passed through an electrolyte acid bath. The electrolyte composition, temperature and current density are precisely controlled to provide a uniform oxide layer on the surface. Some processes use sodium hydroxide, for example, to prepare the surface of the aluminum to etch the existing oxide prior to anodization.

There are many methods of anodization that provide slightly different surface characteristics or thicknesses and are selected based on the function or purpose of the aluminum part. For example, Type I anodization is used to generate a thin film (0.5 to 0.1 mm) generally on parts with tight tolerances. Type II anodization produces coatings up to 1 mil for conventional coatings and up to 4 mils for hard coatings and has greater durability than surfaces treated with Type I anodization.

Hardcoat or hard anodizing (Type III) is preferred because it provides the greatest wear performance, corrosion resistance and smoothest surfaces. Hardcoat anodized films can also be grown to greater thickness (0.002 inches or more if necessary).

The anodized pins may also be polished to provide a surface with a very low coefficient of friction that is also very durable. Although polishing is preferred, polishing of the anodized surfaces is not required.

Accordingly, the reduction of frictional energy losses in the balance pins, front rail pins and action center pins of the piano action with increase the longevity of a piano as well as improve the "touch" or "feel" of the piano. The use of anodized pins with low frictional coefficients and corrosion resistance will also reduce wear of the associated parts, reduce noise and improve the efficiency of the piano action.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A low friction piano key action, comprising:

a front rail;

a balance rail;

a piano key;

a front rail pin coupling said piano key to said front rail; and a balance rail pin coupling said piano key to said balance rail;

wherein each said pin comprising an essentially cylindrically shaped body with an outer surface, a first end and a second end, wherein said essentially cylindrically shaped body further comprises a single notch, said notch being a longitudinal segment of said essentially cylindrically shaped body with a smaller outside diameter than that of the rest of said essentially cylindrically shaped body, said longitudinal segment having an essentially cylindrical shape, a common longitudinal axis with said essentially cylindrically shaped body, and a length of 0.1-10 percent of the total length of said essentially cylindrically shaped body;

wherein each said pin having a hardened oxide layer formed on said outer surface.

2. A piano key action as recited in claim 1, further comprising: a polished hardened oxide surface upon said outer surface of said essentially cylindrically shaped body with said notch.

3. A piano key action as recited in claim 1, wherein said essentially cylindrically shaped body with said notch is composed of aluminum metal.

4. A piano key action as recited in claim 1, wherein said essentially cylindrically shaped body with said notch is a metal selected from the group consisting essentially of aluminum alloy, titanium, zinc, and magnesium.

5. A piano key action as recited in claim 1, wherein said hardened oxide layer of said essentially cylindrically shaped body with said notch is formed by anodization.

6. A piano key action as recited in claim 1, wherein said hardened oxide layer has hardness of between approximately Rockwell C60 and approximately Rockwell C70.

* * * * *